US005839023A

United States Patent [19]

Morigami

[11] Patent Number: 5,839,023

[45] Date of Patent: Nov. 17, 1998

[54] FIXING APPARATUS AND CONTROL METHOD THEREOF

[75] Inventor: Yuusuke Morigami, Toyohashi, Japan

[73] Assignee: Minolta Co., Ltd., Osaka, Japan

[21] Appl. No.: 731,966

[22] Filed: Oct. 23, 1996

[30] Foreign Application Priority Data

Oct. 25, 1995 [JP] Japan ..... 7-277465

[51] Int. Cl.[6] ..... G03G 15/20

[52] U.S. Cl. ..... 399/69; 219/216; 399/67; 399/88

[58] Field of Search ..... 399/67, 69, 90, 399/88, 330, 328; 219/216

[56] References Cited

U.S. PATENT DOCUMENTS

| | | | |
|---|---|---|---|
| 4,471,210 | 9/1984 | Eijnden | 219/216 |
| 4,724,305 | 2/1988 | Iimura et al. | 219/216 X |
| 4,745,431 | 5/1988 | Kogure et al. | 399/69 |
| 4,801,968 | 1/1989 | Kogure et al. | 399/334 |
| 4,994,852 | 2/1991 | Matsuuchi et al. | 399/33 |
| 5,274,423 | 12/1993 | Kusumoto | 399/69 |
| 5,300,996 | 4/1994 | Yokoyama et al. | 399/69 |
| 5,321,478 | 6/1994 | Nakamura et al. | 399/70 |
| 5,334,817 | 8/1994 | Nakamura et al. | 219/216 X |
| 5,386,272 | 1/1995 | Nakazato | 399/33 |
| 5,412,453 | 5/1995 | Matsuo | 399/33 |
| 5,521,686 | 5/1996 | Muto | 399/69 |

FOREIGN PATENT DOCUMENTS

| | | |
|---|---|---|
| 63-24568 | 2/1988 | Japan . |
| 1-274617 | 11/1989 | Japan . |
| 5-11564 | 3/1993 | Japan . |
| 5-24930 | 6/1993 | Japan . |
| 5-210335 | 8/1993 | Japan . |
| 8-234619 | 9/1996 | Japan . |

*Primary Examiner*—Matthew S. Smith
*Attorney, Agent, or Firm*—Burns, Doane, Swecker & Mathis, LLP

[57] ABSTRACT

A fixing apparatus which is equipped with a heat roller that has a resistance heating member generating heat by means of current supply and which is constructed such that current is supplied to the resistance heating member from the power source through a power supply member electrically connected to the resistance heating member, wherein abnormal temperature increases in the heat roller and in the power supply member can be prevented separately, as well as a control method for the fixing apparatus. The fixing apparatus detects the temperature of the heat roller and the temperature of the power supply member, and then stops the supply of current to the resistance heating member when the temperature of the heat roller is higher than a predetermined temperature for the heat roller or the temperature of the power supply member is higher than a predetermined temperature for the power supply member.

23 Claims, 5 Drawing Sheets

FIXING APPARATUS AND CONTROL METHOD THEREOF

BACKGROUND OF THE INVENTION

1. Field of the Invention

The present invention pertains to a fixing apparatus used in an image forming device such as an electrophotographic copy machine or printer, as well as to the control method for said fixing apparatus, and more particularly, to a fixing apparatus that heats an unfixed image, such as an unfixed toner image, in order to fix said image onto a recording medium holding said image.

2. Description of the Related Art

A fixing apparatus used in an image forming device such as a printer or copy machine is usually equipped with a heat roller to fix the unfixed image onto the recording medium through heating. The recording medium holding the unfixed image, such as an unfixed toner image, is fed between this heat roller and a backup member (generally a pressure roller) that is placed to face said heat roller and is subjected to heat and pressure while passing between these rollers. This fixs the unfixed image onto the recording medium.

For the heat roller, a roller having a built-in heater such as a halogen lamp heater, such that the roller is heated by the radiant heat from the heater, has been used in many instances.

However, when using a heat roller having a built-in heater such as a halogen lamp heater, it takes a long time for the surface of the heat roller to reach a prescribed fixing temperature after electric current begins to be supplied to the heater. Consequently, the preheat time, i.e., the period between the time when the power switch of the image forming device is turned ON and the time when the fixing apparatus reaches the prescribed temperature, is long, which reduces the ease of use of the device accordingly.

Therefore, as a heat roller that requires a shorter period of time to reach the prescribed temperature, a heat roller has been proposed that has a resistance heating member that comprises a material that generates heat when current is supplied to it and that is formed on the core roller of said heat roller such that it will rotate together with the core roller. An example of this is disclosed in Japanese Laid-Open Patent Sho 59-189381. A heat roller of this type is efficient in electro-thermal conversion, and can rapidly increase the temperature of the heat roller surface to the prescribed level after current begins to be supplied to the resistance heating member. This reduces the preheat time for the fixing apparatus.

In a fixing apparatus in which the above mentioned heat roller is employed, an excess temperature increase preventing means is usually used in order to ensure safety and to protect the fixing apparatus.

Among such excess temperature increase preventing means, those described below are known: (1) one that involves a resistance heating member of heat roller formed of a material having a negative temperature coefficient and a breaker placed in the circuit used to supply current to the resistance heating member, said breaker breaking the circuit if an excessive amount of current flows when the temperature of the resistance heating member increases abnormally and its resistance decreases, as disclosed in Japanese Laid-Open Utility Model Sho 63-24568; (2) one that involves a power supply member that is in contact with a receiving member that is electrically connected to and rotates together with the resistance heating member, wherein said power supply member melts down due to the heat of the heat roller if the temperature of the heat roller increases abnormally, such that the supply of current to the resistance heating member will be terminated, as disclosed in Japanese Published Utility Model Hei 5-11564; and (3) one that involves a power supply member that is in contact with a receiving member that is electrically connected to and rotates together with the resistance heating member, wherein said power supply member changes configuration due to the heat of the heat roller if the temperature of the heat roller increases abnormally, such that said power supply member will separate from the receiving member and the supply of current to the resistance heating member will be terminated, as disclosed in Japanese Published Utility Model Hei 5-24930.

In the fixing apparatus in which a heat roller equipped with a resistance heating member is employed, a current supply unit is used to supply current to the resistance heating member. For example, this current supply unit comprises, as described above, a power supply member called a power supply brush or current supply brush that is, under a prescribed pressure, in contact with a receiving member (generally a member having a ring configuration) that is electrically connected to and rotates together with the resistance heating member. In this current supply unit, and particularly in its power supply member, heat is generated and temperature increases for the most part independently of the heat roller main unit. This temperature increase in the current supply unit is caused mainly by Joule heat that occurs, when current is supplied, as a result of the current supply unit's specific resistance that has little temperature dependency. This heat generation and temperature increase in the current supply unit, and in its power supply member in particular, is marked when recording media are continuously fed through, or in so-called continuous print mode. In other words, the temperature of the power supply member can easily increase to an abnormal level in continuous print mode.

When recording medium are continuously fed through the fixing apparatus in continuous print mode, even if the heat roller main unit that directly contributes to image fixing is within the appropriate temperature range, there are cases in which the temperature of the power supply member increases abnormally. If this abnormal temperature increase is ignored, plastic deformation caused by such things as thermal destruction and oxidation of the power supply member occurs, which makes the supply of current to the heat roller unstable and affects other components in the vicinity of the current supply unit.

Therefore, in order to further ensure safety and to protect the current supply unit as well as the entire fixing apparatus, it is preferred to prevent not only an abnormal temperature increase in the heat roller but also an abnormal temperature increase in the current supply unit, and its power supply member in particular. However, it is not possible to detect an abnormal temperature increase in the power supply member based on the volume of the current and break the current supply circuit merely using a breaker as disclosed in Japanese Laid-Open Utility Model Sho 63-24568, because the power supply member has a specific resistance with little temperature dependency.

Where a power supply member that will melt down due to an abnormal temperature increase in the heat roller is employed, as disclosed in Japanese Published Utility Model Hei 5-11564, while the heat roller can be protected from an abnormal temperature increase, the power supply member cannot be protected because it melts down when temperature increases. In continuous print in particular, there is a further inconvenience that even when the heat roller main unit is still within the normal temperature range, if the power supply member experiences an abnormal temperature increase and melts down, the power supply member can no longer be used, and furthermore the supply of current to the resistance heating member of the heat roller, which is still within the normal temperature range, also stops.

Where a power supply member is employed that changes its configuration when the temperature of the heat roller increases abnormally such that it will separate from the receiving member, as disclosed in Japanese Published Utility Model Hei 5-24930, the same inconvenience as that seen in Japanese Published Utility Model Sho 5-11564 described above occurs.

SUMMARY OF THE INVENTION

The object of the present invention is to provide an improved fixing apparatus in which the problems described above are resolved, as well as a control method for said fixing apparatus.

Another object of the present invention is to provide a fixing apparatus that is equipped with a heat roller having a resistance heating member that generates heat when current is supplied to it and that is constructed such that current is supplied to the resistance heating member from the power source through a power supply member electrically connected to the resistance heating member, wherein abnormal temperature increases in the heat roller and in the power supply member can be prevented separately, as well as a control method for said fixing apparatus.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

One embodiment of the present invention is explained below with reference to the drawings.

Figure 1:
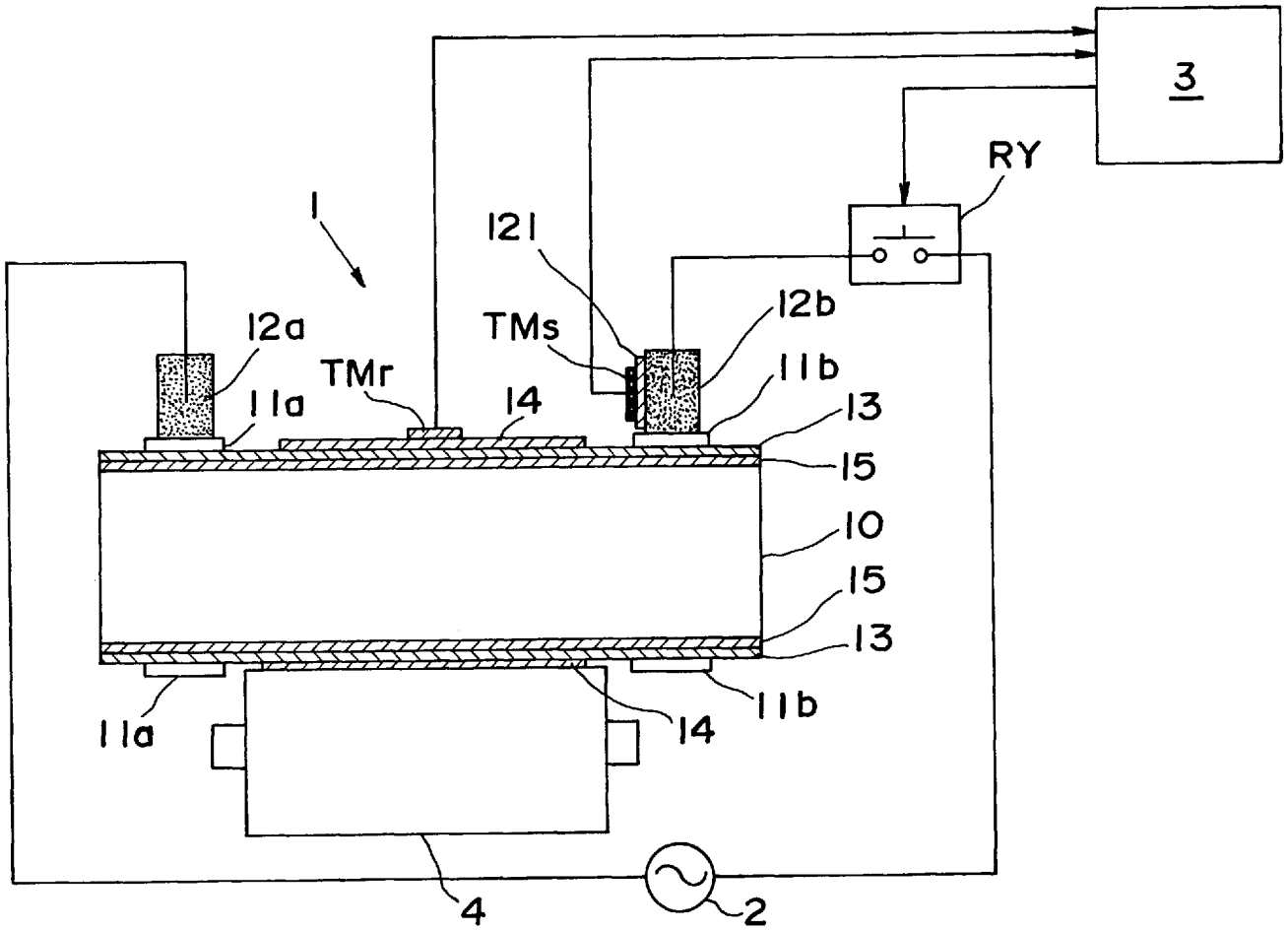
FIG. 1 is a schematic cross-sectional view of a fixing apparatus, an embodiment of the present invention.

The apparatus shown in FIG. 1 is a fixing apparatus that subjects an unfixed toner image (unfixed images) to heat and fixs it onto recording paper (a recording medium) that holds said toner image. FIG. 1 is a schematic cross-sectional view of said apparatus.

This fixing apparatus has heat roller 1 and pressure roller 4 that is pressed against said heat roller by means of a pressing means not shown in the drawing. Heat roller 1 and pressure roller 4 are each rotatably supported by a support means not shown in the drawing, and are each driven to rotate by a drive means not shown in the drawing. Heat roller 1 has cylindrical aluminum core roller 10. Electrical insulating layer 15 is formed on and around the outer surface of core roller 10. Resistance heating member 13 having a layered configuration is formed on and around the outer surface of electrical insulating layer 15, and separating layer 14 is formed on and around the outer surface of resistance heating member layer 13. Separating layer 14 is formed such that the heated toner image may be easily separated from heat roller 1 when recording paper is conveyed while being sandwiched between heat roller 1 and pressure roller 4 facing said heat roller, and has a width larger than the largest possible width of the recording paper. Separating layer 14 is formed of polytetrafluoroethylene (PTFE), a heat-resistant resin that has a separating property. Resistance heating member layer 13 is formed to be wider than separating layer 14 such that receiving members 11*a* and 11*b* described below may be mounted on it. Resistance heating member layer 13 is formed of a barium titanate ceramic with a positive temperature coefficient, which generates Joule heat by itself when current is supplied to it. Electrical insulating layer 15 is formed between resistance heating member layer 13 and core roller 10 in order to maintain electrical insulation between said two members, and is formed of polyimide, a heat-resistant insulating resin. Resistance heating member layer 13, separating layer 14 and electrical insulating layer 15 rotate together with core roller 10 in a united fashion.

A pair of ring-shaped receiving members 11*a* and 11*b* consisting of conductive copper alloy are mounted over the outer circumference of resistance heating member layer 13 at both ends that are not covered by separating layer 14 described above. Receiving members 11*a* and 11*b* are fixed to resistance heating member layer 13. Receiving members 11*a* and 11*b* also rotate together with core roller 10 in a united fashion.

A pair of conductive carbon power supply members 12*a* and 12*b* are placed and fixed on the outer surfaces of receiving members 11*a* and 11*b*, respectively. This power supply member 12*a* (12*b*) presses down receiving member 11*a* (11*b*) by means of a pressing means not shown in the drawing, such that if receiving member 11*a* (11*b*) rotates together with core roller 10 in a united fashion, electrical contact will be maintained between the contact surfaces of both members.

Power supply member 12*a* is connected to one end of power source 2 while power supply member 12*b* is connected to the other end of power source 2 via relay RY. As a result, voltage is applied from power source 2 to resistance heating member layer 13 when the contact point of relay RY is closed.

Control unit 3, which is a control means that outputs instruction signals for the opening and closing of the contact point of relay RY, is connected to relay RY. Control unit 3 has a processing circuit including a CPU (central processing unit), and carries out temperature control of heat roller 1 and abnormal temperature increase prevention regarding power supply members 12*a* and 12*b* using a method described below. Thermistor TMr that detects the temperature of heat roller 1 and thermistor TMs that detects the temperature of power supply member 12*b* are connected to control unit 3. Thermistor TMr is in contact with the outer surface of separating layer 14 of heat roller 1, while thermistor TMs is in contact with power supply member 12*b* via electrical insulating layer 121. Electrical insulating layer 121 is placed between power supply member 12*b* and thermistor TMs such that the relatively large current that flows through power supply member 12*b* will not destroy thermistor TMs, control unit 3 connected to said thermistor, or other components. Electrical insulating layer 121 is formed of polyimide, a heat-resistant insulating resin. If the insulation between thermistor TMs and power supply member 12*b* can be maintained because thermistor TMs is covered by an insulating coating, etc., electrical insulating layer 121 may be omitted.

Figure 2:
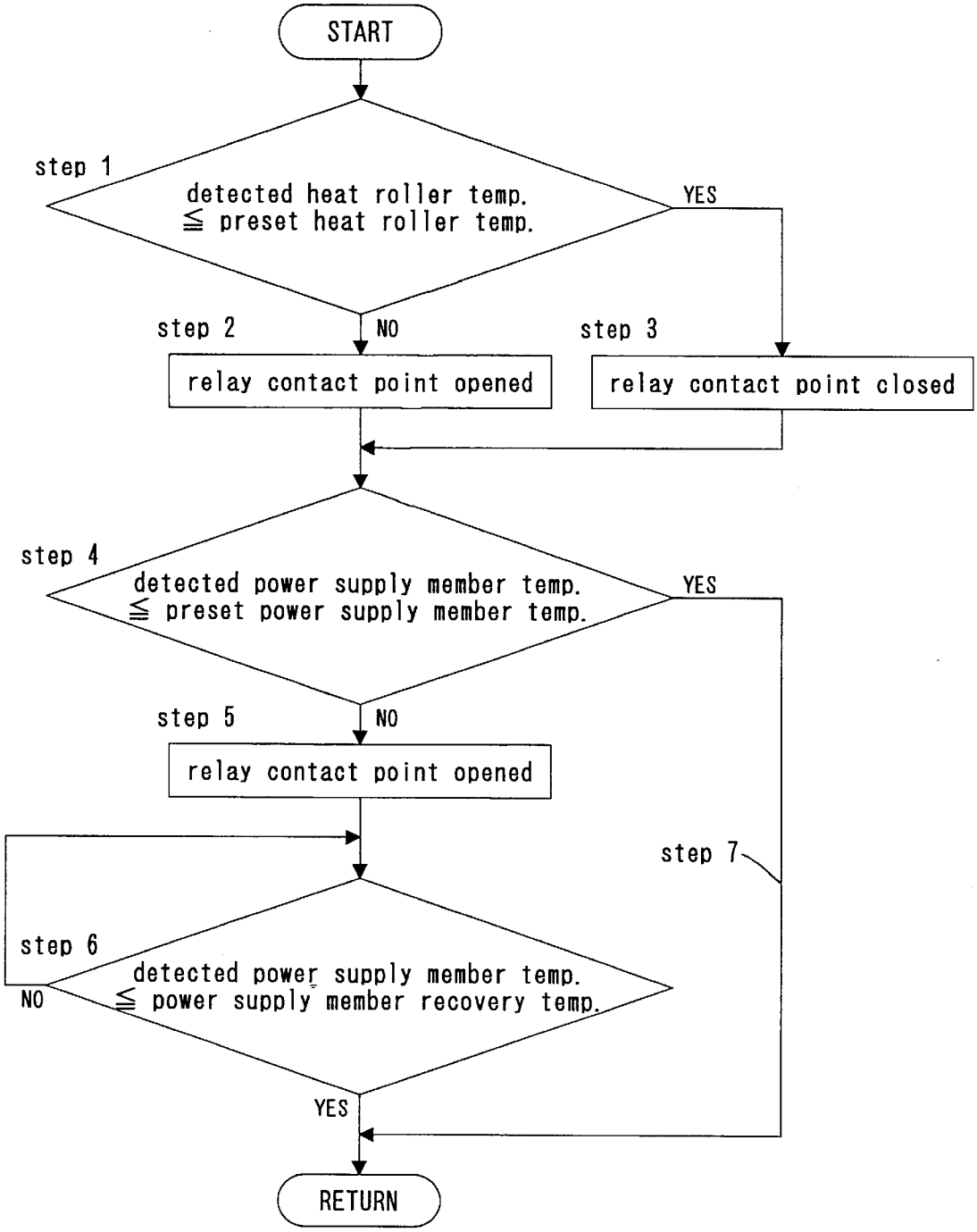
FIG. 2 is a flow chart showing the sequence of the abnormal temperature increase prevention routine for the heat roller and the power supply member, which is carried out by the control unit of the fixing apparatus of the present embodiment.
Figure 3:
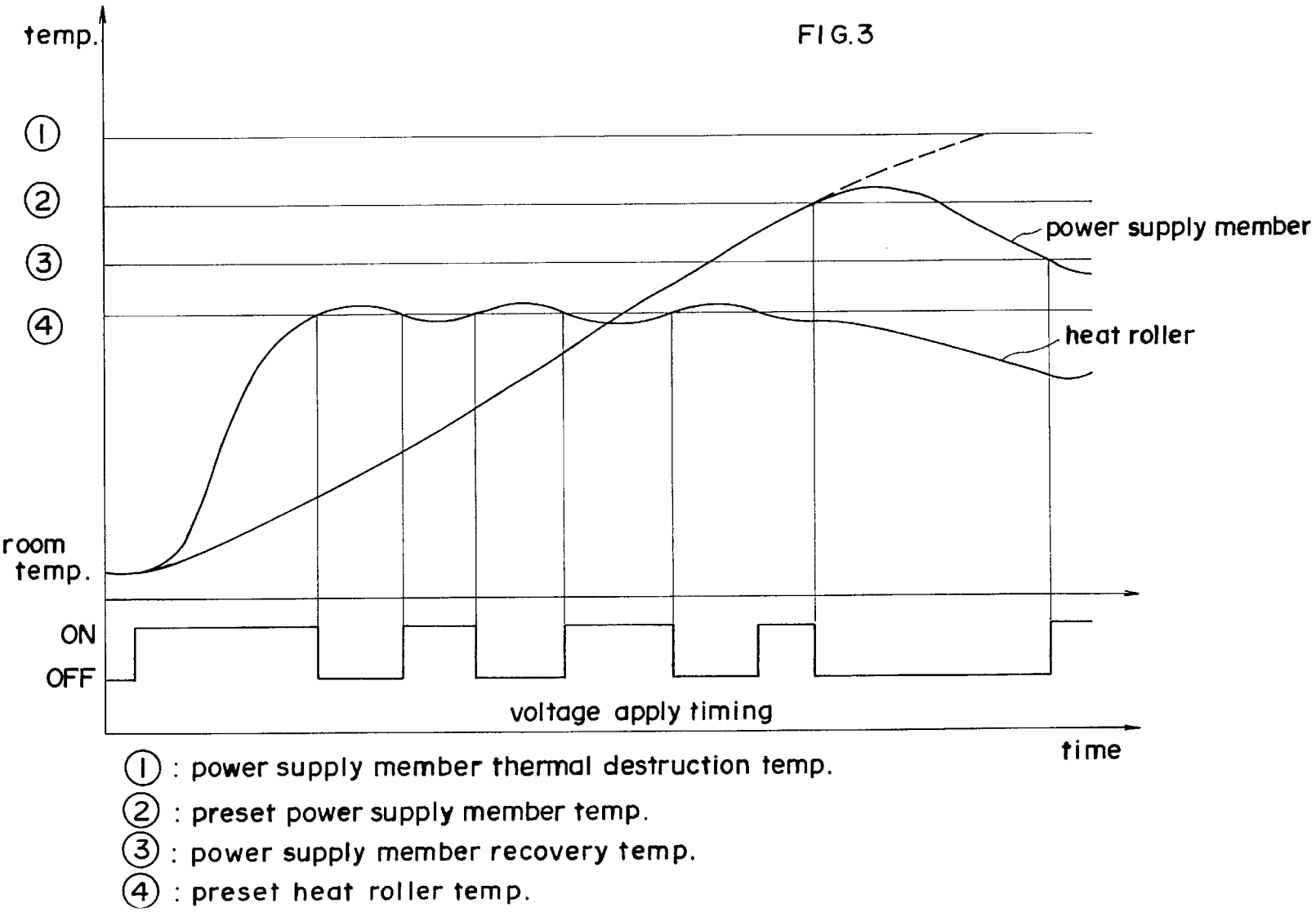
FIG. 3 is a graph showing the temperature changes in the heat roller and in the power supply member, as well as a timing chart showing the timing for application of voltage to the resistance heating member.

The prevention of abnormal temperature increases in heat roller 1 and in power supply members 12*a* and 12*b* in this fixing apparatus is explained with reference to FIGS. 2 and 3. FIG. 2 is a flow chart showing the sequence of the abnormal temperature increase prevention routine carried out by control unit 3 for heat roller 1 and power supply members 12*a* and 12*b*. FIG. 3 is a graph that shows temperature changes in heat roller 1 and in power supply members 12*a* and 12*b*, as well as a timing chart showing the timing at which voltage is applied to resistance heating member layer 13.

In the initial condition, heat roller 1 and power supply members 12*a* and 12*b* are at room temperature, as shown in FIG. 3. Since the temperature of heat roller 1 detected by thermistor TMr is lower than the preset temperature for the heat roller, the contact point of relay RY is closed by control unit 3 (step 1 (YES) and step 3 in FIG. 2). The heat roller preset temperature is set to be lower than the temperature at which thermal destruction of heat roller 1 takes place, while high enough to thermally fix the toner image onto the recording paper.

When the contact point of relay RY is closed, voltage is applied to resistance heating member layer 13 by power source 2 via power supply members 12*a* and 12*b*, receiving members 11*a* and 11*b* and relay RY. Resistance heating member layer 13 generates Joule heat by itself as a result of this application of voltage and increases the temperature of heat roller 1.

When the temperature of heat roller 1 detected by thermistor TMr has become higher than the heat roller preset temperature, as shown in FIG. 3, control unit 3 opens the contact point of relay RY (step 1 (NO) and step 2 in FIG. 2) and stops the application of voltage to resistance heating member layer 13. This stops the temperature increase in heat roller 1 as well. The temperature of heat roller 1, whose temperature stopped increasing, decreases via self-cooling. When the detected temperature of heat roller 1 has once again become equal to or lower than the heat roller preset temperature, control unit 3 closes the contact point of relay RY (step 1 (YES) and step 3 in FIG. 2) and begins to apply voltage to resistance heating member layer 13 once more. By repeating step 1 and step 2 or step 3 in this way, the temperature of heat roller 1 is maintained at the heat roller preset temperature, i.e., at or around the fixing temperature. In addition, because the heat roller preset temperature is set to be lower than the temperature that would lead to the thermal destruction of heat roller 1, heat roller 1 will not be destroyed through an abnormal temperature increase, its temperature is adjusted and an abnormal temperature increase is also prevented.

However, even if the temperature of heat roller 1 is maintained at the heat roller preset temperature (i.e., the fixing temperature), when recording media are continuously fed through the fixing apparatus, power supply members 12*a* and 12*b* easily experience abnormal temperature increases. Therefore, as indicated by a dotted line in FIG. 3, the temperatures of power supply members 12*a* and 12*b* in a conventional apparatus increase to a level at which their thermal destruction takes place (the power supply member thermal destruction temperature).

In the fixing apparatus of this embodiment, when the temperature detected by thermistor TMs placed to be in contact with power supply member 12*b* via electrical insulating layer 121 is equal to or lower than the power supply member preset temperature, which is set to be lower than the power supply member thermal destruction temperature, the contact point of relay RY that was closed in step 3 in FIG. 2 maintains that state (step 4 (YES) and step 7 in FIG. 2) so that the application of voltage to resistance heating member layer 13 will continue. On the other hand, when the temperature of power supply member 12*b* detected by thermistor TMs has become higher than the power supply member preset temperature, control unit 3 opens the contact point of relay RY (step 4 (NO) and step 5 in FIG. 2) to stop the application of voltage to resistance heating member layer 13, which cuts off current to power supply members 12*a* and 12*b*.

The temperature of power supply member 12*b* then decreases. When the temperature of power supply member 12*b* detected by thermistor TMs has become equal to or lower than a power supply member recovery temperature set to be lower than the power supply member preset temperature, and if the temperature of heat roller 1 detected by thermistor TMr is equal to or lower than the heat roller preset temperature, the contact point of relay RY is closed (step 6 (YES), step 1 (YES) and step 3 in FIG. 2). This begins the application of voltage to resistance heating member layer 13 once more. It is possible to set the power supply member recovery temperature to be the same as the power supply member preset temperature, but in this case, while an abnormal temperature increase in the power supply member would be prevented, the temperature of the heat roller would not be maintained at the prescribed fixing temperature because the application of voltage to the resistance heating member layer is controlled based on the power supply member's detected temperature, as a result of which the fixing apparatus could not achieve the prescribed fixing performance. Therefore, in this embodiment the power supply member recovery temperature is set to be lower than the power supply member preset temperature, as a result of which abnormal temperature increases in power supply members 12*a* and 12*b* are prevented and the temperature of heat roller 1 is maintained at the prescribed fixing temperature (i.e., the heat roller preset temperature). In this embodiment, since the thermal destruction temperature (or the normal operation critical temperature) of power supply members 12*a* and 12*b* is higher than the thermal destruction temperature (or normal operation critical temperature) of heat roller 1, the power supply member preset temperature is set to be higher than the heat roller preset temperature.

As described above, in the fixing apparatus of this embodiment, heat roller 1 and power supply members 12*a* and 12*b* (and therefore receiving members 11*a* and 11*b*) can be protected by preventing abnormal temperature increases in heat roller 1 and in power supply members 12*a* and 12*b*. In addition, because power supply members 12*a* and 12*b* do not melt down or change configuration due to abnormal temperature increases, so long as heat roller 1 and power supply members 12*a* and 12*b* are both within their respective temperature ranges for normal operation, the application of voltage to resistance heating member layer 13 need not be needlessly stopped.

Figure 4:
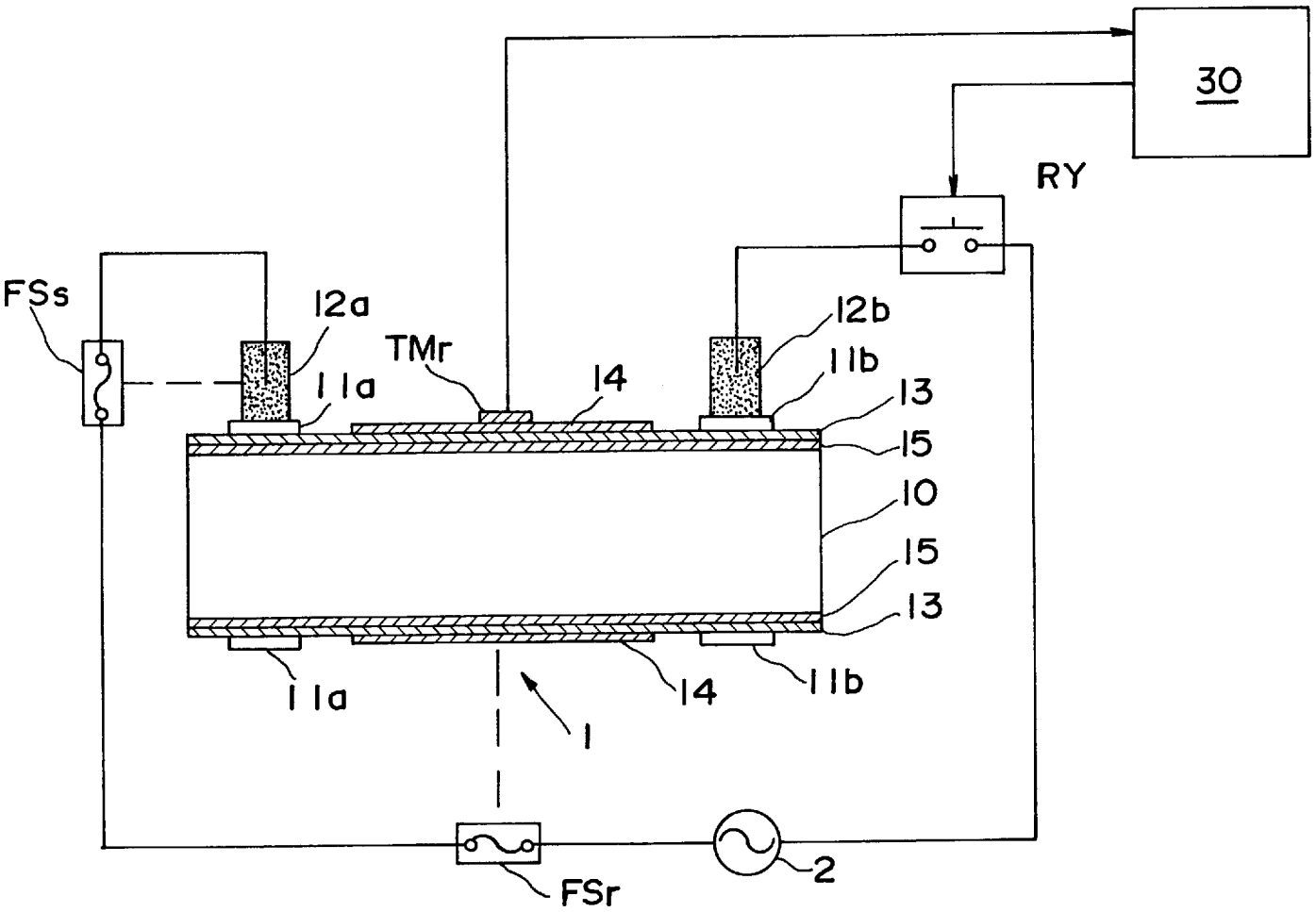
FIG. 4 is a schematic cross-sectional view of a fixing apparatus, another embodiment of the present invention.

A fixing apparatus, which is another embodiment of the present invention, will now be explained with reference to FIG. 4. FIG. 4 is a schematic cross-sectional view of said fixing apparatus, except that the pressure roller is omitted from the drawing.

The fixing apparatus shown in FIG. 4 differs from the fixing apparatus shown in FIG. 1 in the following respects: (1) in addition to thermistor TMr, which is a temperature detection means for heat roller 1, temperature fuse FSr that works as a temperature detection means and a circuit breaking means is also used for heat roller 1; and (2) in place of thermistor TMs, which is a temperature detection means for power supply member 12*b*, temperature fuse FSs that works as a temperature detection means and a circuit breaking means is used for power supply member 12*a*.

The construction of the fixing apparatus in FIG. 4 is otherwise the same as the fixing apparatus of the first embodiment shown in FIG. 1.

The same numbers are used for components of the fixing apparatus shown in FIG. 4 that have essentially the same constructions and operations as the components of the fixing apparatus shown in FIG. 1.

Temperature fuses FSr and FSs are placed near heat roller 1 and power supply member 12*a*, respectively, while each being supported by a support means not shown in the drawing. In the fixing apparatus of this embodiment, one end of power source 2 is connected to resistance heating member layer 13 via receiving member 11*a*, power supply member 12*a*, temperature fuse FSs and temperature fuse FSr, and the other end of power source 2 is also connected to resistance heating member layer 13 via receiving member 11*b*, power supply member 12*b* and the contact point of relay RY, such that voltage may be applied to the resistance heating member layer 13 by power source 2.

In the fixing apparatus of this second embodiment shown in FIG. 4 as well, the temperature of heat roller 1 is adjusted to the prescribed fixing temperature by means of thermistor TMr, control unit 30 and relay RY in the same manner as in the fixing apparatus shown in FIG. 1. In this case, control unit 30 carries out step 1, and step 2 or step 3 of the flow chart shown in FIG. 2.

In the fixing apparatus of the first embodiment shown in FIG. 1, the fixing temperature and the heat roller preset temperature are the same. By contrast, in the apparatus pertaining to the second embodiment shown in FIG. 4, the heat roller preset temperature is different from the fixing temperature: the former is set to be higher than the latter.

In the fixing apparatus of this embodiment, temperature fuse FSr is also used for heat roller 1. Where the temperature of heat roller 1 has become higher than the heat roller preset temperature for some reason, such as a delay in the response of thermistor TMr, the voltage application path to resistance heating member layer 13 is broken by temperature fuse FSr that operates at a temperature higher than the heat roller preset temperature but lower than the thermal destruction temperature of heat roller 1, such that an abnormal temperature increase in heat roller 1 will be prevented. The prevention of an abnormal temperature increase in heat roller 1 thus becomes even more reliable by using temperature fuse FSr.

When the temperature of power supply member 12*a* has become higher than the power supply member preset temperature, the voltage application path to resistance heating member layer 13 is broken by temperature fuse FSs that is placed for power supply member 12*a* which operates at a temperature higher than the power supply member preset temperature but lower than the thermal destruction temperature of power supply members 12*a* and 12*b*, such that an abnormal temperature increase in power supply member 12*a* and 12*b* will be prevented.

The thermal destruction temperature (or normal operation critical temperature) of power supply members 12*a* and 12*b* is higher than the thermal destruction temperature (or normal operation critical temperature) of heat roller 1 in this embodiment as well. Therefore, the power supply member preset temperature is set to be higher than the heat roller preset temperature.

The fixing apparatus of the second embodiment shown in FIG. 4 also has the same effect as the apparatus pertaining to the first embodiment shown in FIG. 1.

Figure 5:
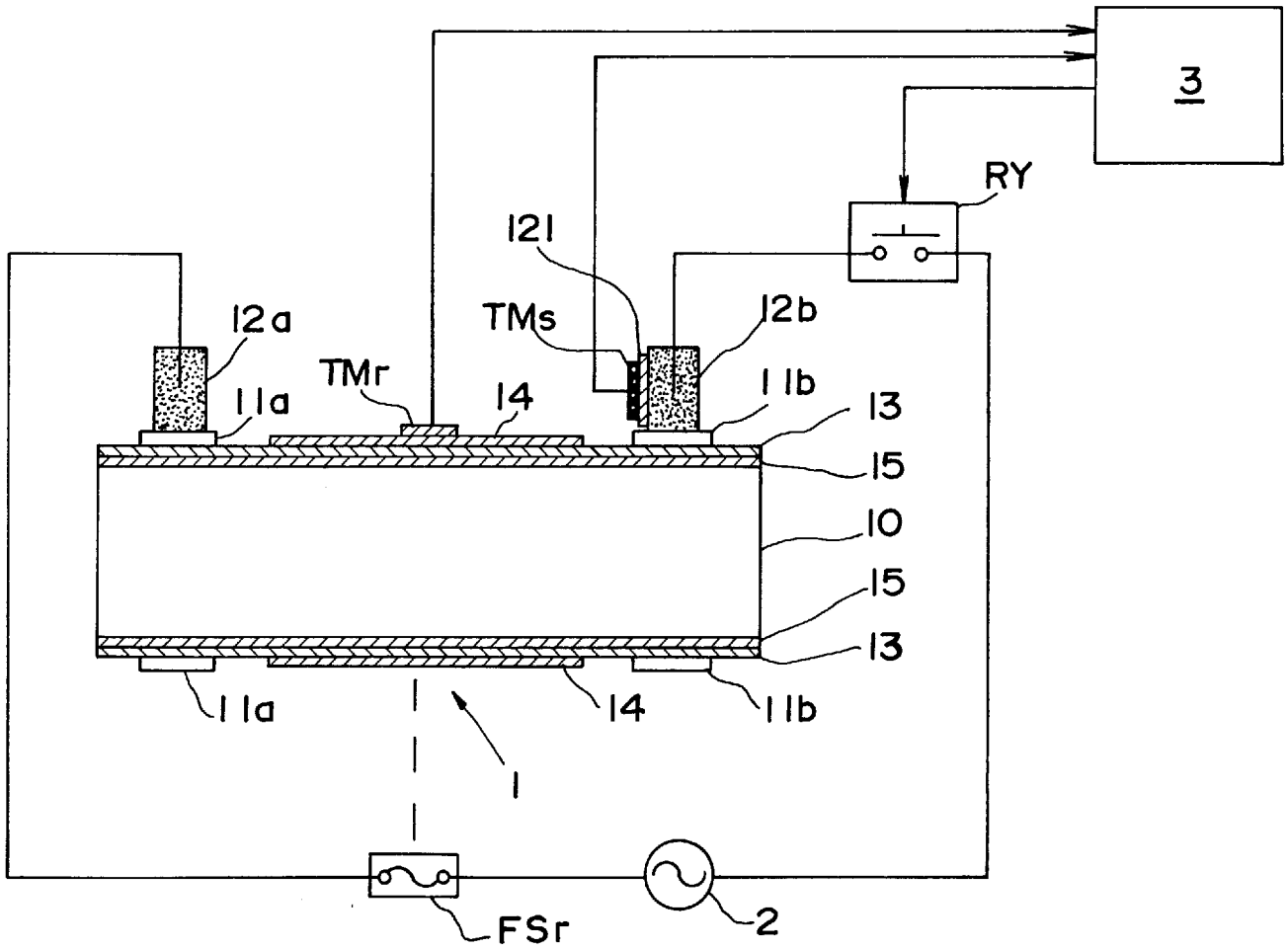
FIG. 5 is a schematic cross-sectional view of a fixing apparatus, yet another embodiment of the present invention.

A fixing apparatus pertaining to yet another embodiment of the present invention will now be explained with reference to FIG. 5. FIG. 5 is a schematic cross-sectional view of said fixing apparatus, except that the pressure roller is omitted from the drawing.

The fixing apparatus shown in FIG. 5 has a construction in which the fixing apparatuses of the first and second embodiments shown in FIGS. 1 and 4 are combined.

(1) Thermistor TMr that detects the temperature of heat roller 1 and temperature fuse FSr that works as a temperature detection means and a circuit breaking means are used for heat roller 1 in the same manner as in the fixing apparatus of the second embodiment shown in FIG. 4.

(2) Thermistor TMs, which is a temperature detection means, is used for power supply member 12*b* in the same manner as in the fixing apparatus of the first embodiment shown in FIG. 1.

The construction of the fixing apparatus of this embodiment is otherwise the same as those of the fixing apparatuses of the first and second embodiments shown in FIGS. 1 and 4.

The same numbers are used for components of the fixing apparatus shown in FIG. 5 that have essentially the same constructions and operations as the components of the fixing apparatus shown in FIGS. 1 and 4.

Using this apparatus, the temperature of heat roller 1 is adjusted to the prescribed fixing temperature through the opening and closing of the contact point of relay RY in accordance with the instructions from control unit 3 to open or close said contact point based on detected temperature information from thermistor TMr. The routine of control unit 3 in this apparatus takes place essentially in the same sequence as that shown in the flow chart in FIG. 2.

When the temperature of heat roller 1 has become higher than the heat roller preset temperature that is set in temperature fuse FSr for the purpose of preventing an abnormal temperature increase in the heat roller, temperature fuse FSr blows, which breaks the supply of current to resistance heating member layer 13. This prevents an abnormal temperature increase in heat roller 1.

When the temperature of power supply member 12*b* detected by thermistor TMs has become higher than the power supply member preset temperature for the purpose of preventing abnormal temperature increases in the power supply members, the contact point of relay RY is opened based on an instruction from control unit 3, which breaks the supply of current to resistance heating member layer 13. This prevents abnormal temperature increases in power supply members 12*a* and 12*b*.

After the contact point of relay RY is opened due to a temperature increase in power supply member 12*b*, when the temperature of power supply member 12*b* has become equal to or lower than the prescribed recovery temperature and if the detected temperature of heat roller 1 is equal to or lower than the heat roller preset temperature, the contact point of relay RY is closed again, whereupon the supply of current to resistance heating member layer 13 begins once more.

Because the thermal destruction temperature (or normal operation critical temperature) of power supply members 12*a* and 12*b* is higher than the thermal destruction temperature (or normal operation critical temperature) of heat roller 1 in this embodiment as well, the power supply member preset temperature is set to be higher than the heat roller preset temperature.

The power supply member recovery temperature is set to be lower than the power supply member preset temperature, as in the first embodiment.

In each of the fixing apparatuses described above, recording paper holding an unfixed toner image is fed through heat roller 1 that is maintained at a prescribed fixing temperature and pressure roller 4. The toner image is then fixed onto the recording paper while being subjected to heat and pressure.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, temperature fuses FSr and FSs that are used in the fixing apparatuses of the embodiments described above may be replaced with other circuit breaking means such as thermostats.

The materials of the components of the fixing apparatuses shown pertaining to the embodiments described above need not be limited to those mentioned above.

While the fixing apparatuses of the embodiments described above are equipped with a heat roller in which a resistance heating member is formed over the outer surface of the core roller, the present invention may also be applied in a fixing apparatus that has a heat roller in which a resistance heating member is formed over the inner surface of the core roller.

What is claimed is:

1. A fixing apparatus comprising:

a heat roller having a resistance heating member that generates heat when current is supplied thereto;

a power supply member that is electrically connected to said resistance heating member;

a power source that applies voltage to said resistance heating member by way of said power supply member;

a first detection means for detecting the temperature of said heat roller;

a second detection means for detecting the temperature of said power supply member; and a control means for stopping the supply of current to said resistance heating member when at least one of the following conditions is present: (1) the temperature detected by said first detection means is higher than a first predetermined temperature, or (2) the temperature detected by said second detection means is higher than a second predetermined temperature.

2. The fixing apparatus as claimed in claim 1, wherein the values of said first and second predetermined temperatures are different.

3. The fixing apparatus as claimed in claim 2, wherein said first predetermined temperature is lower than said second predetermined temperature.

4. The fixing apparatus as claimed in claim 1, wherein said second detection means is placed to be in contact with said power supply member by way of an electrically insulating member.

5. The fixing apparatus as claimed in claim 1, wherein said control means restarts to supply the current to said resistance heating member when the temperature detected by said first detection means is equal to or lower than said first predetermined temperature and the temperature detected by said second detection means is equal to or lower than a third predetermined temperature after the supply of current to said resistance heating member is stopped because of said condition (2).

6. The fixing apparatus as claimed in claim 5, wherein said third predetermined temperature is lower than said second predetermined temperature.

7. A fixing apparatus comprising:

a heat roller having a resistance heating member that generates heat when current is supplied thereto;

a power supply member that is electrically connected to said resistance heating member;

a power source that applies voltage to said resistance heating member by way of said power supply member;

a first detection means for detecting the temperature of said heat roller;

a second detection means for detecting the temperature of said power supply member;

a first breaking means for being located in a current supply circuit between said power supply member and said power source, and for breaking the current supply circuit when the temperature detected by said first detection means is higher than a first predetermined temperature; and a second breaking means for being located in said current supply circuit, and for breaking the current supply circuit when the temperature detected by said second detection means is higher than a second predetermined temperature.

8. The fixing apparatus as claimed in claim 7, wherein the values of said first and second predetermined temperatures are different.

9. The fixing apparatus as claimed in claim 8, wherein said first predetermined temperature is lower than said second predetermined temperature.

10. The fixing apparatus as claimed in claim 7, wherein said first and second breaking means each comprise a temperature fuse.

11. The fixing apparatus as claimed in claim 10, wherein each of said temperature fuses also works as a temperature detection means.

12. A fixing apparatus comprising:

a heat roller having a resistance heating member that generates heat when current is supplied thereto;

a power supply member that is electrically connected to said resistance heating member;

a power source that applies voltage to said resistance heating member by way of said power supply member;

a first detection means for detecting the temperature of said heat roller;

a second detection means for detecting the temperature of said power supply member;

a breaking means for being located in a current supply circuit between said power supply member and said power source, and for breaking the current supply circuit when the temperature detected by said first detection means is higher than a first predetermined temperature; and a control means for stopping the supply of current to said resistance heating member when the temperature detected by said second detection means is higher than a second predetermined temperature.

13. The fixing apparatus as claimed in claim 12, wherein the values of said first and second predetermined temperatures are different.

14. The fixing apparatus as claimed in claim 13, wherein said first predetermined temperature is lower than said second predetermined temperature.

15. The fixing apparatus as claimed in claim 12, wherein said second detection means is placed to be in contact with said power supply member by way of an electrically insulating member.

16. The fixing apparatus as claimed in claim 12, wherein said breaking means comprises a temperature fuse.

17. The fixing apparatus as claimed in claim 16, wherein said temperature fuse also works as a temperature detection means.

18. The fixing apparatus as claimed in claim 12, wherein said control means restarts to supply the current to said resistance heating member when the temperature detected by said first detection means is equal to or lower than said first predetermined temperature and the temperature detected by said second detection means is equal to or lower than a third predetermined temperature after the supply of current to said resistance heating member is stopped by said control means.

19. The fixing apparatus as claimed in claim 18, wherein said third predetermined temperature is lower than said second predetermined temperature.

20. A control method for a fixing apparatus equipped with a heat roller that has a resistance heating member that generates heat when current is supplied thereto, and constructed such that current is supplied to the resistance heating member from the power source by way of a power supply member electrically connected to the resistance heating member, said control method comprising the following steps of:

a first step of detecting the temperature of said heat roller and the temperature of said power supply member; and a second step of stopping the supply of current to said resistance heating member when at least one of the following conditions is present: (1) the temperature of said heat roller is higher than a first predetermined temperature, or (2) the temperature of said power supply member is higher than a second predetermined temperature.

21. The method as claimed in claim 20, wherein said first predetermined temperature is lower than said second predetermined temperature.

22. The method as claimed in claim 20, wherein said second step includes a step of restarting to supply the current to said resistance heating member when the temperature of said heat roller is equal to or lower than said first predetermined temperature and the temperature of said power supply member is equal to or lower than a third predetermined temperature after the supply of current to said resistance heating member is stopped because of said condition (2).

23. The method as claimed in claim 22, wherein said third predetermined temperature is lower than said second predetermined temperature.

* * * * *